US006942003B2

(12) United States Patent
Thompson

(10) Patent No.: US 6,942,003 B2
(45) Date of Patent: Sep. 13, 2005

(54) ROLL-UP DOOR CURTAIN AND GUIDES AND BOTTOM BAR THEREFOR

(75) Inventor: David S. Thompson, King, CA (US)

(73) Assignee: Service Door Industries Limited, Mississauga (CA)

( * ) Notice: Subject to any disclaimer, the term of this patent is extended or adjusted under 35 U.S.C. 154(b) by 0 days.

(21) Appl. No.: 10/627,365

(22) Filed: Jul. 25, 2003

(65) Prior Publication Data

US 2005/0016695 A1 Jan. 27, 2005

(51) Int. Cl.[7] ..... A47G 5/02

(52) U.S. Cl. ..... 160/268.1; 160/41; 160/271; 160/273.1

(58) Field of Search ..... 160/268.1, 133, 160/41, 290.1, 269, 273.1, 271, 265, 113, 117

(56) References Cited

U.S. PATENT DOCUMENTS

| | | | | | |
|---|---|---|---|---|---|
| 3,638,913 | A | * | 2/1972 | Persicke | 256/13.1 |
| 4,219,969 | A | * | 9/1980 | Reinitz et al. | 49/141 |
| 4,263,750 | A | * | 4/1981 | Hein | 49/490.1 |
| 4,303,117 | A | * | 12/1981 | Lindbergh | 160/189 |
| 4,436,137 | A | * | 3/1984 | Charles | 160/242 |

(Continued)

FOREIGN PATENT DOCUMENTS

| | | | | |
|---|---|---|---|---|
| EP | 0554864 | * | 2/1993 | 160/268.1 X |

OTHER PUBLICATIONS

Leaflet of SDI, entitled "Service Door Industries Presents A New Breakthrough In The Rolling Door Industry"; 2 pages, published May 30, 2001 in Canada.

*Primary Examiner*—Bruce A. Lev
(74) *Attorney, Agent, or Firm*—Gifford, Krass, Groh, Sprinkle, Anderson & Citkowski, P.C.

(57) ABSTRACT

A roll up door assembly for covering a door space comprising a rubber sheet having vertical side edge portions with a front lock strip secured to the front surface and a rear lock strip secured to the rear surface of each vertical side edge. The front and rear locking strips are staggered with respect to each other in the transverse direction of these strips. The sheet is coilable on a barrel mounted above the door. The staggered orientation of the lock strips assists in the tracking of the sheet during coiling on the barrel. A pair of vertically extending door guides each define a vertical slot oriented and sized to accept a respective vertical side edge portion for guided vertical movement therein. Each door guide assembly has a windbar attached thereto, positioned to narrow the opening of the slot such the narrowed opening has a smaller width than the total thickness of each side edge portion of the sheet. Tension spring assemblies bias the windbar with sufficient force to normally hold the vertical side edge portion within the slot while permitting the side edge portion to be released from the slot through the opening upon an impact to the sheet. A bottom bar assembly secured to the bottom edge of said sheet comprises a centrally located hinge and two bar sections each connected to the hinge. A strap is connected to the bar sections by shear bolts and extends across the hinge.

27 Claims, 5 Drawing Sheets

U.S. PATENT DOCUMENTS 4,478,268 A 10/1984 Palmer
5,025,847 A 6/1991 Mueller
5,139,074 A 8/1992 Warner
5,139,075 A * 8/1992 Desrochers ..... 160/310
5,271,448 A * 12/1993 Delgado ..... 160/265
5,392,836 A 2/1995 West et al.
5,438,798 A * 8/1995 Plamper et al. ..... 49/28
5,445,209 A 8/1995 Lichy
5,493,815 A * 2/1996 Belser et al. ..... 49/490.1
5,526,865 A * 6/1996 Coenraets ..... 160/272
5,601,133 A * 2/1997 Krupke et al. ..... 160/265
5,620,039 A 4/1997 Delgado et al.
5,657,805 A 8/1997 Magro
5,727,614 A * 3/1998 Lichy ..... 160/201
5,732,911 A * 3/1998 Kulp et al. ..... 248/158
5,765,622 A * 6/1998 Lichy ..... 160/273.1
5,794,678 A * 8/1998 Beringer et al. ..... 160/41
5,829,504 A * 11/1998 Ekstrand et al. ..... 160/201
5,964,270 A 10/1999 Kirkey et al.
6,035,918 A * 3/2000 Kraeutler ..... 160/84.06
6,053,237 A * 4/2000 Bertilsson et al. ..... 160/205
6,068,040 A 5/2000 Magro et al.
6,397,921 B1 * 6/2002 Wartenbergh ..... 160/267.1
6,431,250 B2 8/2002 Mullet et al.
6,574,832 B1 * 6/2003 Boerger et al. ..... 16/90
6,612,357 B1 * 9/2003 Beringer et al. ..... 160/10
6,691,761 B1 * 2/2004 Alkhoury et al. ..... 160/273.1
6,715,531 B2 * 4/2004 Simon ..... 160/271
6,722,416 B2 * 4/2004 Varley et al. ..... 160/264
2002/0030183 A1 * 3/2002 Albritton ..... 256/13.1

* cited by examiner

ROLL-UP DOOR CURTAIN AND GUIDES AND BOTTOM BAR THEREFOR

FIELD OF THE INVENTION

This invention relates to roll-up doors utilized to open and close large door openings and in particular to doors of this type made from a large rubber curtain designed to withstand impacts.

BACKGROUND OF THE INVENTION

Rubber roll-up doors for industrial and commercial use have been known for some time. An example is disclosed in U.S. Pat. No. 4,478,268 to Palmer issued Oct. 23, 1984. A primary advantage of a door of this type which is made from a rubber curtain is that it is designed to withstand an accidental impact from a vehicle or other object while standard doors of other types (such as steel doors) will often be destroyed or cause damage to the impacting object.

In order to reduce the likelihood of tearing of the rubber door upon impact, it is desirable that the door be capable of disengaging from the door frame upon impact. U.S. Pat. No. 5,392,836 to West et al., issued Feb. 28, 1995 teaches a rubber door with its vertical side edges insertable into door guides positioned adjacent each vertical side of the door. Mounted along the vertical edges of the roll-up door are a number of hemispherical follower elements which are spaced apart from one another and vertically aligned. These elements are bolted to the edge of the door, and are made of hard plastic material or some other compressible material. The vertical sides of the door are inserted in the door guides, each guide forming a narrow gap through which the vertical edges of the door may be inserted. These guide members have tapered portions that form a tapered inward section which allows for a wedging action by the follower elements causing the guide to open up and release the door edge under impact conditions.

U.S. Pat. No. 5,964,270 to Kirkey et al., issued Oct. 12, 1999 teaches the use of thickened edges along the vertical side edges of a roll-up type door, which are insertable in spaced apart guide channels, positioned along the vertical sides of the frame of the door. A sloping shoulder is formed where each side edge section meets the thinner main area of the door. Friction reducing wear resistant fabric strips are bonded to both of the side edge sections and extend therealong. The thicker side edges are designed to be pulled from the guide channels under impact forces.

It is known also to provide a weighted bottom bar attached to the bottom edge of roll up doors, designed to assist in the raising and lowering of the door and to minimize damage to the door structure during accidental collision therewith. For example, U.S. Pat. No. 5,025,847 to Mueller, issued Jun. 25, 1991 discloses a bottom bar connected to tensioning means located in door guides and that are connected to horizontal tabs mounted on the bottom bar. The bottom bar includes vertically extending U shaped brackets and a sliding block assembly mounted therebetween. The block assembly has interlocking portions which are connected together by dove tail connectors. A shear pin extends through a passage extending through the dove tail connector. An impact to the bottom bar causes the shear pin to be sheared off, thereby permitting release of the section of the bottom bar connected to the curtain.

U.S. Pat. No. 5,139,074 to Warner, issued Aug. 18, 1992 discloses a bottom bar attached to a roll down door composed of superimposed strips of resilient material such as rubber and metal strips. Each end of the bottom bar is provided with a longitudinal open-ended slot and an extension of the bottom bar is mounted within each slot in a manner such that the extensions can slide freely in the slots in a direction parallel to the plane of the door. These extensions will release from the slots if the bar is subjected to an accidental impact.

SUMMARY OF THE INVENTION

It is an object of the invention to provide a roll up door and assembly therefor with improved features designed to protect the door under impact conditions.

In accordance with an aspect of the invention there is provided a roll-up door assembly for selectively covering the door space defined by a door frame, comprising a flexible sheet having top and bottom edges, a front and a back side and elongate vertical side edge portions of greater thickness than the remaining portion of the curtain. The side edge portions have elongate, vertical, inner side edge surfaces that extend substantially perpendicular to the remaining portion of the curtain when the sheet is unrolled and flat. A horizontally extending barrel is adapted for rotatable mounting above the door frame. The sheet is attached to the barrel and is coilable upon the barrel for storage thereupon and is selectively extendable downwardly therefrom to extend over the door space during use of the door assembly. A pair of vertically extending door guides assemblies are each adapted for mounting adjacent a respective vertical edge of the door frame. Each door guide assembly defines a vertical slot having a vertical opening extending along the length of the slot. Each slot is oriented and sized to accept a respective one of the vertical side edge portions for vertical movement therein. Each door guide assembly has a windbar assembly attached thereto, positioned in a slot narrowing position in which a portion thereof extends over the opening of the slot to narrow said opening such that the narrowed opening has a smaller width than the total thickness of a respective one of the side edge portions. Biasing means biases said windbar assembly to said slot narrowing position with sufficient force to normally hold the respective vertical side edge portion within said slot during use of the door assembly, while permitting the side edge portion to be released from the slot through its opening upon an impact to the sheet.

In accordance with a further aspect of the invention there is provided a roll up curtain for selectively covering a space defined by a door frame comprising a flexible sheet of suitably strong material having top and bottom edges, a front surface and a rear surface, and vertical side edge portions. An elongate front lock strip is secured to the front surface and an elongate rear lock strip is secured to the rear surface along each vertical side edge portion of the curtain. The front and rear locking strips are staggered relative to each other in the transverse direction of the lock strips and the sheet.

In yet a further aspect of the invention there is provided an impact absorbing curtain for selectively covering a space defined by a door frame comprising a flexible sheet of suitably strong material having a front surface, rear surface, a top edge and a bottom edge and vertical side edges, including a bottom bar assembly secured to the bottom edge of said sheet. The bottom bar assembly comprises a hinge and two bottom bar sections each connected to said hinge and extending from the hinge along the bottom edge of the curtain in opposite directions. Each bar section is secured to the bottom edge of said curtain. At least one connecting member is secured between the bottom sections and extends across the hinge, securing the bottom sections in a relative straight, aligned orientation. A securing mechanism is provided to connect the at least one connecting member to the bar sections. The securing mechanism releases on impact to allow hinging of the bottom sections about the hinge, thereby reducing the possibility of damage to the sheet and an impacting object.

According to yet another aspect of the invention, a bottom bar assembly for a roll-up curtain for a door arrangement includes two elongate bottom bar sections for attachment to a bottom edge of the roll-up curtain. Each bottom bar section has an attachment arrangement for attaching the bar section to the bottom edge of the curtain. A hinge pivotably connects adjacent ends of the bottom bar sections so that these sections can extend in opposite directions from the hinge and are aligned with each other during normal use of the bar assembly. At least one connecting member is connected to both of the bottom bar sections, extends across the hinge, and secures the bottom bar sections so that they form a relatively straight bottom bar adapted to extend along the bottom edge of the curtain. Each of the at least one connecting member is connected to at least one of the bottom bar sections by a shear connecting device. The at least one connecting member is able to disconnect from at least one of the bottom bar sections upon a sufficiently large impact on the bottom bar assembly during use thereof. This impact causes the shear connecting device to break. The disconnection allows one of the bar sections to pivot about the hinge relative to the other bar section and thereby reduces the possibility of significant damage to the door arrangement.

Preferably the bottom bar sections are substantially equal in length and the hinge is centrally located on the bar assembly.

BRIEF DESCRIPTION OF THE DRAWINGS

Preferred embodiments of the invention will now be described, by way of example, with reference to the accompanying drawings, in which.

DETAILED DESCRIPTION OF THE DRAWINGS

Figure 1A:
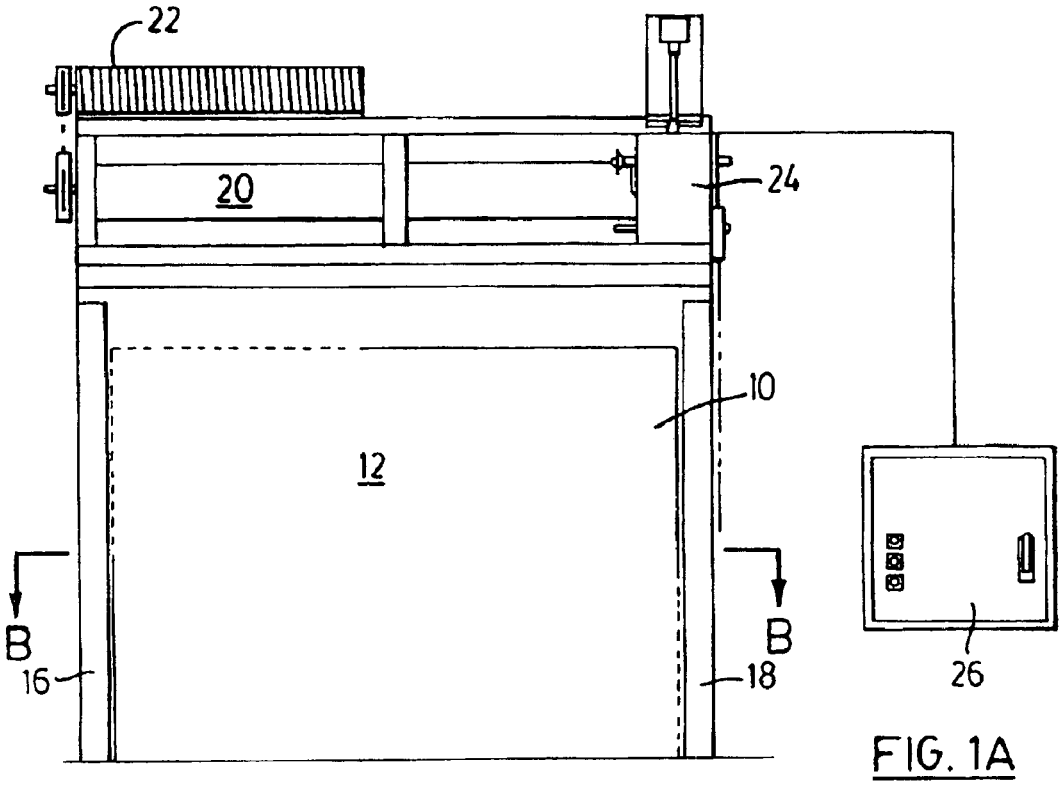
FIG. 1A is a rear side schematic view of a roll up door assembly in accordance with the invention.
Figure 1B:
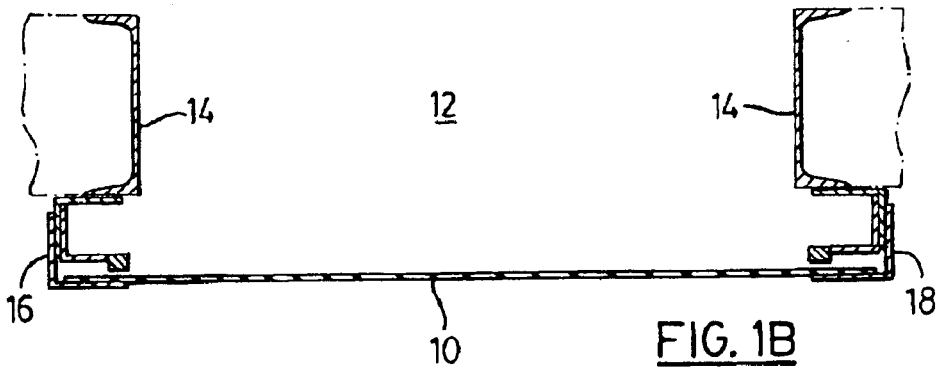
FIG. 1B is a section view taken along line B—B of FIG. 1A.

Shown schematically in FIGS. 1A and 1B are the major components of a preferred embodiment of a roll up door assembly in accordance with an aspect of the invention. A curtain, which is preferably a sheet comprising reinforced SBR rubber is indicated generally at 10 and is sized to cover a rectangular door opening 12. The vertical sides of the door opening are formed and defined by two door jamb members which typically comprise steel channels 14. The rubber curtain 10 that forms the door is able to move up and down carried in two, vertically-extending door guide assemblies 16 and 18, positioned respectively adjacent vertical edges of the door frame, the construction of which will be explained in more detail below.

Figure 1C:
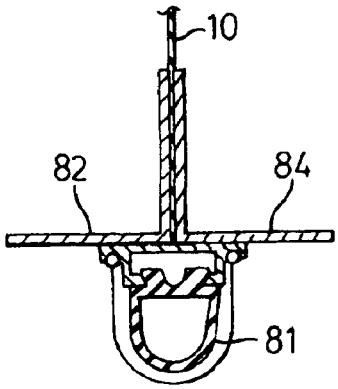
FIG. 1C is a section view of the bottom portion of a curtain and bottom bar section in accordance with the invention taken along line C—C of FIG. 6.

In order to control the opening and closing of the door, the sheet which is preferably a rubber curtain 10 is rolled up and down about a horizontally extending barrel 20, rotatably mounted above the door frame, the rotation of which is normally counterbalanced by means of a coil spring 22. It will be understood that the purpose of the counterbalance is to offset the significant weight of the rubber curtain and thereby reduce the size of the motor required to operate the door and roll-up the curtain. The barrel can be rotated by means of an electric motor and drive assembly indicated generally at 24. A wall mounted control panel 26 can be used to operate the drive assembly and thus to open and close the door as required. Finally it should also be noted that most rubber doors must be provided with a bottom bar assembly 80, an example of which is shown separately in cross-section in FIG. 1C and is described in more detail below. This bar is preferably comprised of two bar sections, each section made with mating angle members such as angle members 82, 84. The bar assembly is attached to the bottom horizontal edge of the curtain in a manner which will be described below, preferably being sandwiched between angle members such as 82 and 84. Along with other features which will be described below, the bottom bar assembly 80 helps to provide weight at the bottom edge of the curtain and helps to pull the curtain smoothly down through the guides when the door is being closed. As can be seen in FIG. 1C, there can be attached to the bottom of this bar, a rounded safety edge 81 of standard construction to cause the door either to stop or reverse direction if it is strikes an object or person.

Figure 2:
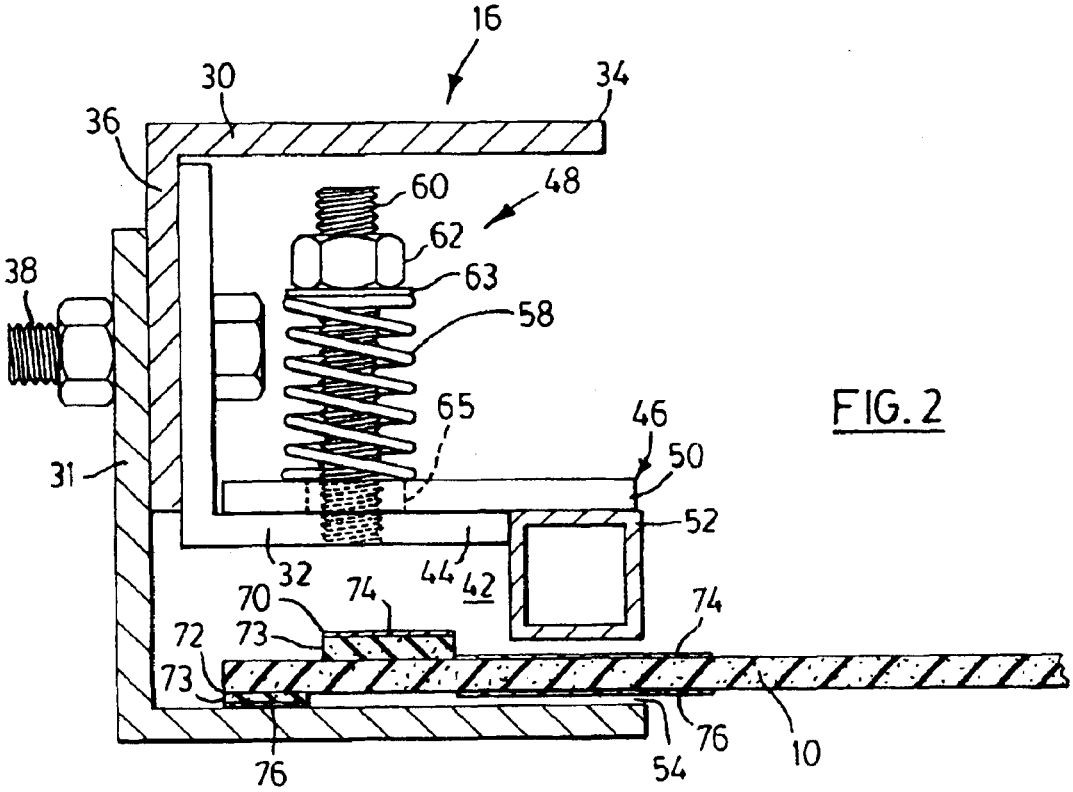
FIG. 2 is a horizontal cross-sectional detail of a vertical side edge portion of a rubber curtain and the guide assembly in accordance with the invention.

Turning now to the construction of the door guide assemblies of the present invention, the horizontal cross section of one embodiment of these guide assemblies 16, 18 is illustrated in FIG. 2. It will be appreciated that each of these guide assemblies extends for at least most of the height of the door opening. A preferred embodiment of the guide assemblies is made from three, structural steel, elongate angle members 30, 31 and 32. It will be appreciated that the leg 34 of the angle member 30 is fixably attached to the side of the door jamb member 14, for example by welding. A number of holes are distributed along the length of the other leg 36 in order to receive a series of bolts 38 which are used to attach the two angle members 31, 32 to the leg 36. It will also be understood that the leg 40 of the angle member 31 forms one side of a guide slot 42 for the rubber curtain 10.

Preferably, the other side of the guide slot is formed by leg 44 of the inner angle member 32. It should be understood that guide assemblies 16, 18 may be formed in any other suitable manner, so long as each guide assembly is fixedly securable to the adjacent door jamb and so long as each defines a vertical slot for insertion of and guiding the vertical edge of the door. A spring loaded windbar assembly 46 is connected to the guide assembly, preferably secured to one side of the leg 44 by means of a series of tension-spring assemblies 48. The windbar assembly is preferably made of steel, consists of an elongate, narrow steel strip 50 and an elongate tube member 52, preferably of square cross-section and welded to the strip 50, and biased to a slot narrowing position where if partially closes one end of the slot 42, leaving a relatively narrow opening or slot 54 for the curtain side edge portion to extend through. In a preferred embodiment, the narrow opening normally has a width of $\frac{3}{8}^{th}$ inch. It will be understood that the windbar assembly 46 is only attached to the angle member 32 by means of the tension-spring assemblies 48. Each of these assemblies includes a coil spring 58, a relatively short, threaded rod 60, a nut 62 and washer 63. It will be understood that the opposite ends of the coil spring press against the washer 63 at one end and the side of steel strip 50 at the other end. The threaded rod 60 extends through a slot or hole 65 and then is screwed into a threaded hole in the leg 44. The coil springs 58 are compressed by adjusting the nuts 62 until a biasing force of the spring assemblies is sufficient to normally hold the adjacent curtain edge in place but is not so great as not to permit release of the curtain edge under impact conditions.

An important aspect of the curtain construction is that the vertical side edge portions of the curtain have a greater total thickness than the rest of the curtain. In particular, each has rubber side lock strips 70, 72 secured thereto that extend along each vertical edge of the curtain. The preferred embodiment of the curtain illustrated in FIG. 2 has both an inner side (also referred to as a front side) lock strip 70 and a smaller outer side (also referred to as a rear side) lock strip 72. The lock strips 70, 72 are preferably made of SBR rubber, the same material preferred for the door curtain. It will be seen that the combined thickness of the two side lock strips 70 and 72 and the edge of the curtain 10 is greater than the width of the opening of the slot 54 and thus the vertical side edges of the curtain will normally be retained in the guide assembly as the door curtain is rolled upwardly or downwardly. Each of the lock strips 70, 72 and adjacent area along the vertical side edges of the curtain is preferably covered on its outer surface with a protective wear strip 74, 76 on the inner and outer sides respectively. These wear strips help reduce wear on the rubber material of the side lock strips and additional wear strips (indicated in FIG. 2) are also used to reduce the wear on the curtain itself. These wear strips are made from a wear resistant polyester fabric that has a low co-efficient of friction.

Figure 3:
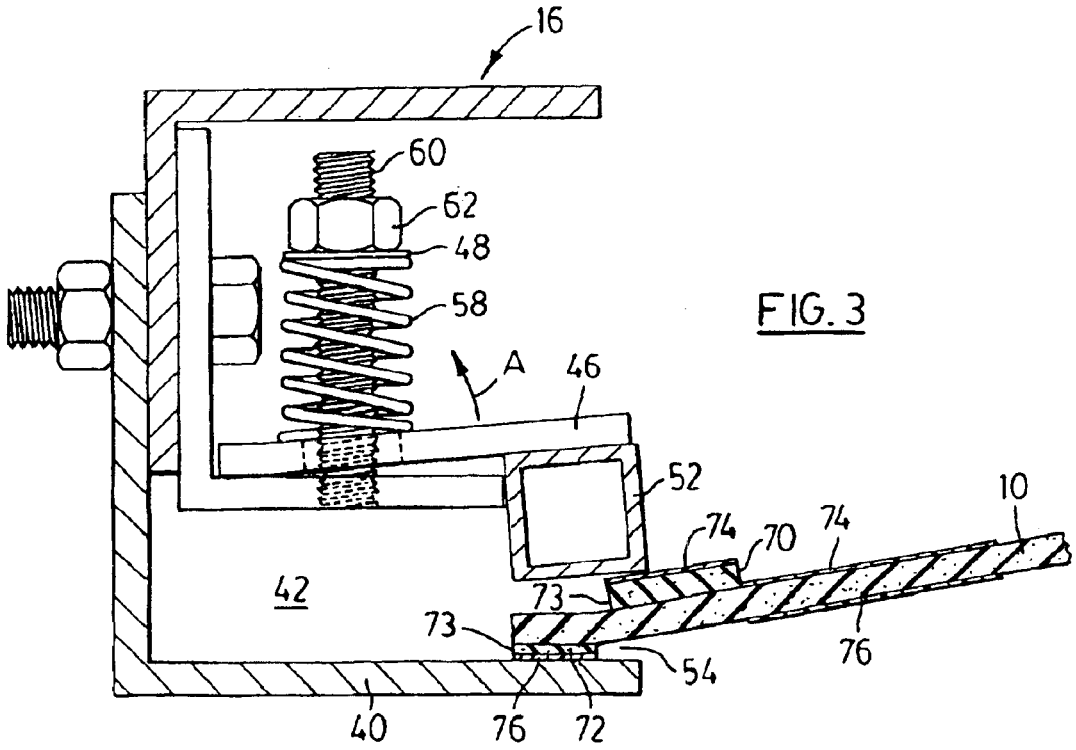
FIG. 3 is a horizontal cross section similar to FIG. 2, illustrating how the vertical side edge portion of the curtain can be pulled from the guide assembly under impact conditions in accordance with the invention.
Figure 5:
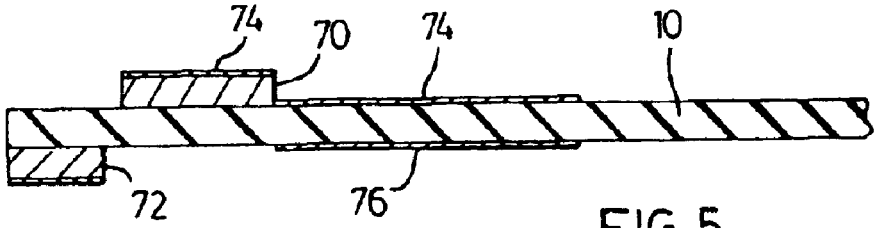
FIG. 5 is a section view of the vertical side edge section of the preferred curtain.

As best seen in FIGS. 2, 3 and 5, in a preferred embodiment, the inner/front side lock strip 70 measures one-inch horizontally across and is ¼ inch in height and the outer/rear lock strip 72 measures ⅝ inch horizontally across and is ¼ inch in height. Preferably, the outer lock strip and inner lock strip are staggered with respect to each other in the transverse direction of the strips and the curtain. In particular the outer lock strip is preferably positioned adjacent to the vertical edge and the inner lock strip is offset ¾ of an inch from the vertical edge of the curtain. This staggered arrangement assists in the tracking of the curtain upon the barrel, as will be discussed in further detail below. Preferably, each of the lock strips 70, 72 has side walls 73 which extend perpendicular to the surface of the curtain. These perpendicular side walls further assist with proper tracking of the sheet when it is rolled upon the barrel 20, help hold the vertical edge sections in their guide assemblies, and aid in the efficient removal of the vertical edge sections from the door guide assemblies upon impact to the door as will be described below.

The manner in which the vertical edge sections of the rubber curtain can be pulled from the door guide assemblies upon impact is illustrated in FIG. 3. If the rubber curtain 10, which preferably is a reinforced SBR curtain of substantial strength, is struck with a vehicle or other object, one or both of the vertical side edge portions will release from the door guide assemblies 16, 18 in the illustrated manner to permit the edge section of the curtain which is in the slot 42 to come out of the slot, thereby preventing damage to the curtain. The edge section of the curtain is able to come out of the slot due to the manner in which the windbar assembly 46 is mounted on the guide assembly. In particular, the impact force on the curtain will cause the lock strip 70 to push against the inner side of tubular member 52 of the windbar assembly which in turn will cause the wind bar assembly to pivot away from the curtain in the direction indicated by the arrow A in FIG. 3. In other words, the biasing force exerted by the tension spring assemblies 48 will be overcome by the pivoting force acting on the windbar assembly 46. The coil springs 58 will therefore compress to the extent necessary to allow the curtain edge to come out. Once the curtain edge has come out, the windbar will return to its normal position. Note that the force required to pull the curtain edge section from the slot 42 can be adjusted by adjusting the position of the nuts 62. It should be understood that the windbar assembly illustrated in the drawings is shown by way of example only and can be formed or shaped in a different manner, for example it can be formed of one integral piece.

Figure 4:
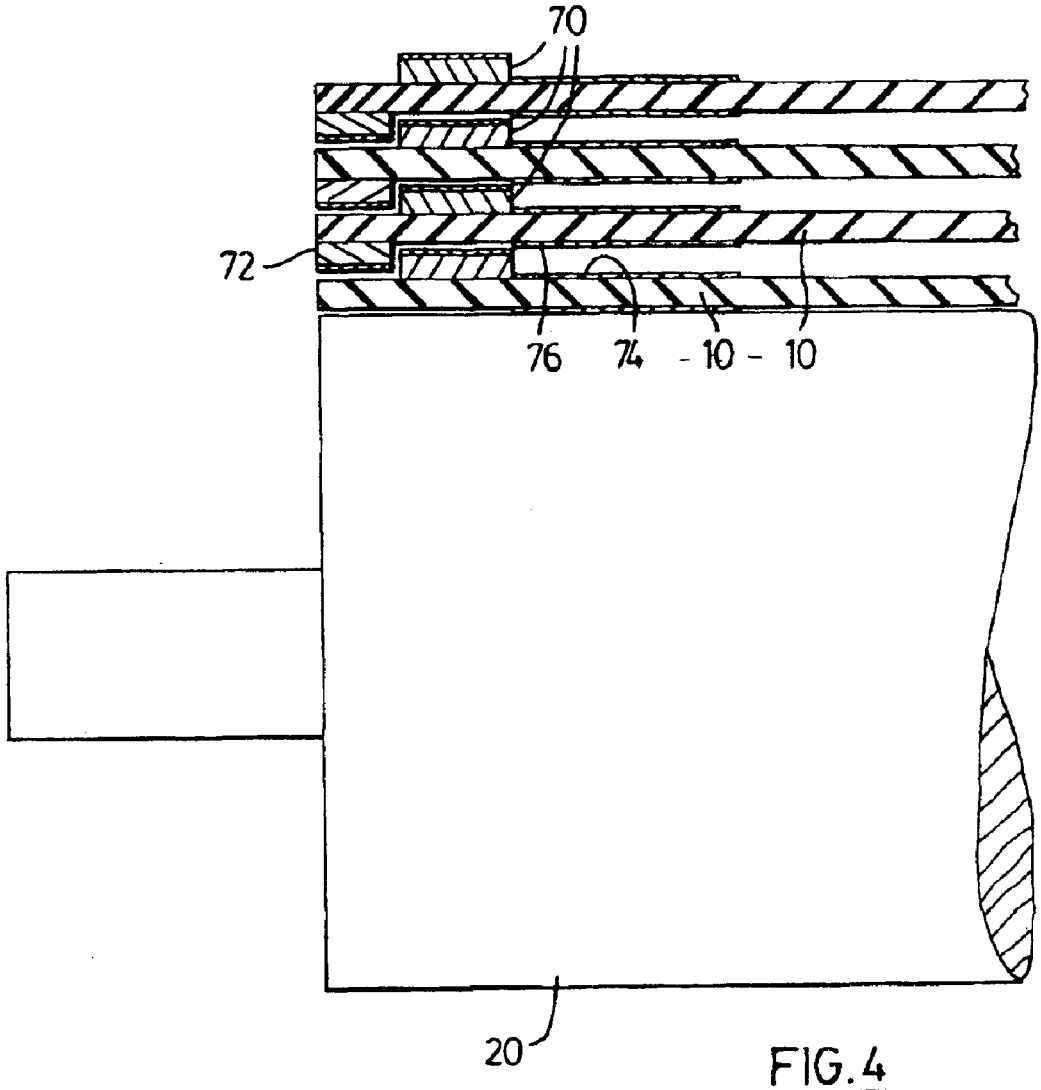
FIG. 4 is an axial cross section showing one vertical side edge of the curtain rolled up on a supporting barrel.

FIG. 4 illustrates how the curtain 10 of this invention will roll up smoothly on the barrel 20 due to the positioning of the side lock strips 70, 72. The above described staggered positioning of the inner/front and outer/rear side lock strips 70 and 72 will assist in the tracking of the curtain while it is coiling on the barrel without adding significantly to the coiling diameter of the curtain. In other words the curtain will remain in its correct rolled position as it is rolled up upon barrel 20 due to the use of the staggered side lock strips 70, 72 with the outer strip. 72 being positioned outwardly from the location of the inner side lock strip 70.

Figure 6:
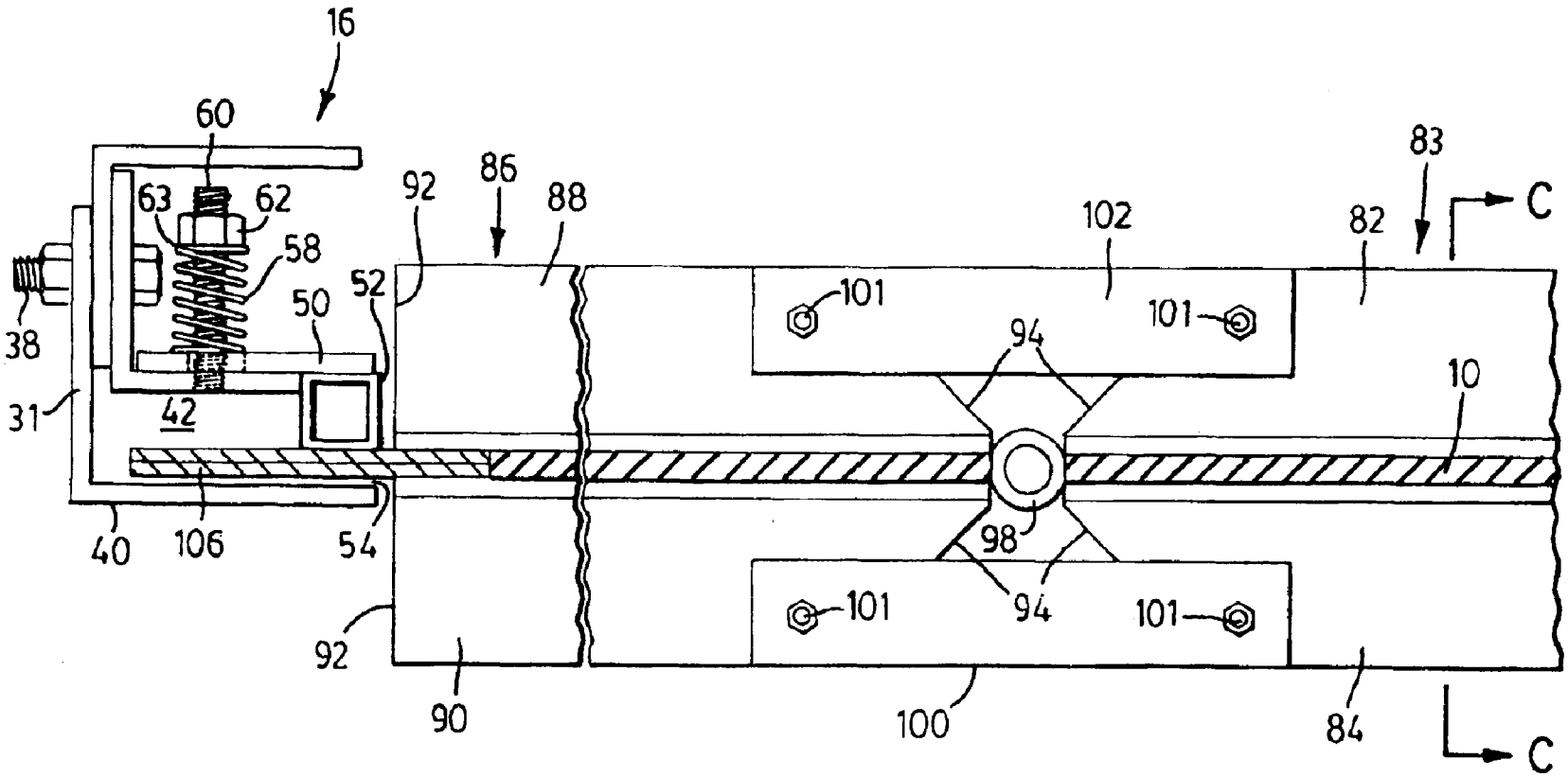
FIG. 6 is a plan view, partly in cross section, of a central portion of a bottom bar assembly attached to the bottom end of the rubber curtain.
Figure 7:
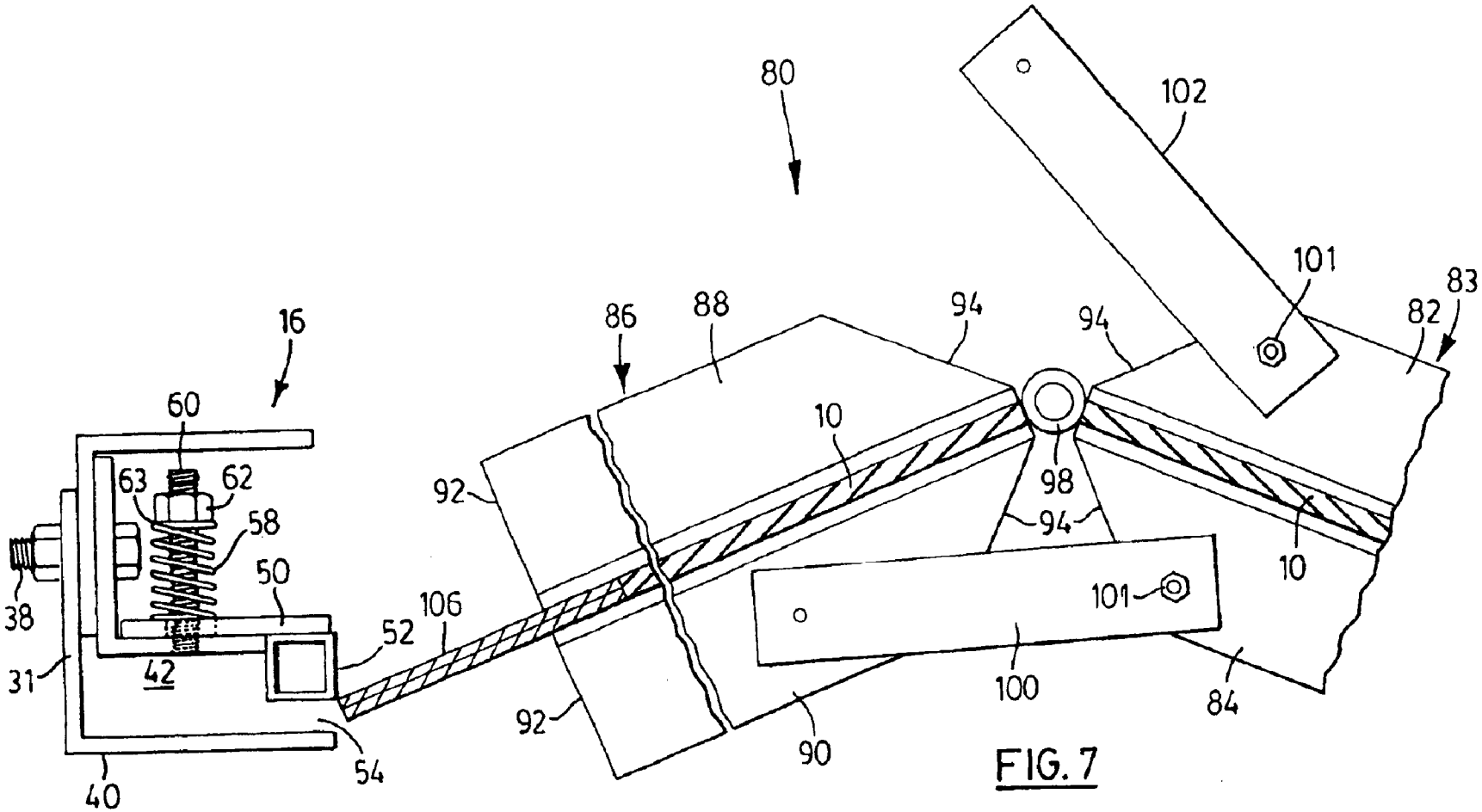
FIG. 7 is a plan view similar to FIG. 6, illustrating how the bottom bar assembly can break away from the guide assembly at one or both ends of the bottom bar.

Another aspect of the invention is shown in FIGS. 6 and 7 (and FIG. 1C) and relates to the bottom bar assembly indicated generally at 80. The bottom bar assembly comprises two similar bottom bar sections 83, 86. Preferably, bottom bar section 83 comprises steel angle members 82, 84 and bar section 86 comprises angle members 88, 90. Each of the angle members pairs 82, 84 and 88,90 are attached together along the horizontal bottom edge of the curtain, sandwiching between them the bottom edge section of the curtain by bolts and nuts (not shown). In this way, each bottom bar section 83, 86 has an attachment arrangement for attaching the bar section to the bottom edge section of the curtain. The bolts extend through holes formed in the bottom of the curtain. The angled members of bar sections 83, 86 have straight edges at their outer ends 92 and have bevelled edges at their inner ends 94. The bottom bar sections 83, 86 are pivotally attached to each other by means of a metal hinge 98 forming a vertical pivot axis. The bevelled edges accommodate relative pivoting of the bar sections about the vertical axis. Preferably this hinge is central located on the bar assembly, but could be positioned elsewhere in a central region of the bar assembly. Located on opposite sides of this hinge and spaced therefrom are at least one and preferably two connecting members or straps 100 and 102, preferably made of steel connected between the bar sections 83, 86. Each connecting strap is connected by means of shear connecting devices in the form of shear bolts 101 to both sections 83, 86. It will be understood that if the bottom bar is impacted, at least one shear bolt 101 for each steel strap will break so as to allow the sections 83, 86 to pivot in the manner shown in FIG. 7. In this way impact forces are absorbed and serious damage to the bottom bar can be avoided under most impact conditions. It should be understood that more than one hinge could be utilized if it is desired to divide the bottom bar assembly into more than two bottom bar sections. Also, connecting members other than flat, steel straps are possible. For example, the connecting members 100, 102 could be elongate, tubular members or angle members.

In order to maintain the ends of the bottom bar in alignment with the door guides, a nylon tab 106 can be mounted at each outer edge 92 of bar sections 83, 86 sandwiched between the angle members, so that the tab projects into the guide slot 42. The nylon tabs can be clamped respectively between the two angle members 82, 84 and 88, 90 of the bar sections. The tab 106 can bend somewhat if it is pulled from the guide slot 42 in an impact situation. Also if the nylon tab 106 is broken by the impact, it can be readily replaced without having to replace the entire bottom bar. Of course, when the bottom bar is reinstalled after an impact has occurred, any broken shear bolts are simply replaced and the steel straps 100 and 102 are again connected in the manner shown in FIG. 6.

It should be appreciated by those skilled in the art that with the curtain construction and bottom bar assembly of the present invention, it is reasonably easy for maintenance personnel to restore the roll-up door curtain to its normal working state after an impact on the curtain or the bottom bar has occurred. In order to restore the door curtain to working condition, the maintenance personnel first lowers the door curtain which has come out of the door guide assemblies to a convenient position. Then the tabs 106 at the outer ends of the bottom bar (which is still in a bendable state) are reinserted into their respective slots of the guide assemblies. The curtain is then raised by coiling the curtain on its barrel and it is raised to its uppermost position. The usual idler barrel, which is mounted adjacent to and parallel to the main barrel 20 helps to ensure that the curtain tracks correctly on the main barrel 20 both when the curtain is raised and then when the curtain is lowered. When the curtain is then lowered using the electric motor and drive assembly 24, the door will correctly feed itself back into the vertical slots of the guide assemblies (since the tabs on the bottom bar will-cause the vertical side edge portions of the door to feed themselves initially into the vertical slots and then to be fed along these slots). After this operation has occurred, the shear bolts of the bottom bar assembly can then be replaced and then the door is back in its normal operating condition. Note that this maintenance operation can be accomplished without the use of ladders or without the need for any special tools.

Although the invention has been described with reference to illustrative embodiments, it is to be understood that the invention is not limited to these precise embodiments, and that various changes and modifications may be effected therein by one skilled in the art. All such changes and modifications are intended to be encompassed in the appended claims.

What is claimed is:

1. A roll up door assembly for selectively covering a door space defined by a door frame, comprising:

a flexible sheet having top and bottom edges, a front and a back side and elongate vertical side edge portions of greater thickness than the remaining portion of the sheet, said side edge portions having elongate, vertical, inner edge surfaces that extend substantially perpendicular to said remaining portion when said sheet is unrolled and flat;

a barrel adapted for rotatable mounting above said door frame, said sheet attached to said barrel and being coilable upon said barrel for storage thereupon and selectively extendable downwardly therefrom to extend over the door space during use of the door assembly;

a pair of vertically extending door guides assemblies each adapted for mounting adjacent a respective vertical edge of the door frame, each door guide assembly defining a vertical slot having a vertical opening extending along the length of the slot, each slot being oriented and sized to accept a respective one of said vertical side edge portions for vertical movement therein;

each said door guide assembly having a windbar assembly attached thereto, positioned in a slot narrowing position in which a portion thereof extends over the opening of said slot to narrow said opening such that the narrowed opening has a smaller width than the total thickness of a respective one of said side edge portions; and biasing means for biasing said windbar assembly to said slot narrowing position with sufficient force to normally hold the respective vertical side edge portion within said slot during use of said door assembly, while permitting the side edge portion to be released from the slot through its opening upon an impact to the sheet.

2. A door assembly as recited in claim 1 wherein each said side edge portion comprises a front side strip and a rear side strip each extending along the respective side edge of the sheet, wherein the front and rear side strips are staggered with respect to each other in the transverse direction of these side strips such that the front and rear side strips do not overlap during coiling of the sheet on the barrel and thereby assist in the tracking of the sheet when coiled on said barrel.

3. A door assembly as recited in claim 2 wherein both of the side edge portions are covered with a low friction protective wear layer.

4. A door assembly as recited in claim 1 wherein said biasing means is provided by tension spring assemblies securing said windbar assembly to its respective guide assembly.

5. A door assembly as recited in claim 4 wherein each tension spring assembly comprises a threaded rod threadably securing said windbar assembly to said guide assembly at one end of the rod, and having a threadably mounted nut on the other end and a coil spring positioned around the threaded rod between the nut and said guide assembly, the nut being threadably advancable on the rod to selectively compress the spring to create a desired biasing force.

6. A door assembly as recited in claim 1 wherein a horizontal bottom bar is secured across the bottom edge of said sheet.

7. A door assembly as recited in claim 6 wherein said bottom bar comprises a hinge and two bottom bar sections each connected to said hinge and extending in opposite directions from the hinge across the bottom of the sheet and secured thereto;

a strap connected to said bar sections across said hinge, said strap holding said bottom sections in a relative straight orientation; and strap securing means for securing said strap to said bar sections, said securing means releasing on impact to allow hinging of the bottom sections about the hinge and thereby reduce the possibility of damage to the sheet and any impacting object.

8. A door assembly as recited in claim 7 wherein said strap securing means comprises shear bolts securing said strap to said bar sections, said shear bolts being made to shear upon sufficient impact to said bar.

9. A door assembly as recited in claim 7 wherein said bottom bar includes a flexible tab member extending from an outer end of each bar section, said tab insertable into a respective one of said vertical slots for assisting with guiding said sheet upwardly and downwardly along said one slot, said tab being disengagable from said one slot upon impact to the bottom bar.

10. A door assembly as recited in claim 7 wherein each said bar section comprises a pair of mating angle members secured together and between which is secured the bottom edge of the sheet.

11. A roll up curtain for selectively covering a space defined by a door frame comprising:

a flexible sheet of suitable strong material having top and bottom edges, a front surface and a rear surface, and vertical side edge portions; and an elongate front lock strip secured to the front surface and an elongate rear lock strip secured to the rear surface along each vertical side edge portion of the sheet, each of said lock strips extending a substantial distance along its respective side edge portion, said front and rear lock strips being staggered relative to each other in the transverse direction of said lock strips and the sheet.

12. A curtain as recited in claim 11 wherein the top edge of the sheet is secured to a barrel adapted to be rotatably mounted above said door frame, said sheet being coilable upon said barrel for storage thereupon and selectively extendable downwardly therefrom to extend over the door space, said staggered front and rear locking strips being able to track the sheet when said sheet is being coiled upon said barrel, keeping the vertical side edge portions of the sheet rolled in a straight alignment.

13. A curtain as recited in claim 11 wherein said material of the sheet comprises reinforced SBR rubber.

14. A curtain as recited in claim 11 wherein at least said front locking strips each have at least an inner side wall which extends perpendicular to the adjacent surface of the sheet.

15. A curtain as recited in claim 14 wherein said rear lock strips are each secured to said rear surface next to a respective vertical edge of said sheet and said front lock strips are each secured to said front surface at a location spaced from the respective vertical edge of said sheet and inwards of the adjacent rear lock strip.

16. A curtain as recited in claim 11 wherein low friction wear strips are applied to said vertical side edge portions including said rear lock strips.

17. A curtain as recited in claim 11 wherein a bottom bar assembly is secured to the bottom edge of said curtain, said bottom bar assembly comprising a hinge and two bottom bar sections each connected to said hinge and extending from the hinge across the bottom edge of the sheet in opposite directions;

at least one strap connected to both of said bar sections and extending across said hinge, said at least one strap securing said bar sections in relative straight orientation; and strap securing means for securing said at least one strap to said bar sections, said securing means releasing on impact to allow hinging of the bottom sections about the hinge and thereby reducing the possibility of damage to the curtain or an impacting object.

18. A curtain as recited in claim 17 wherein said strap securing means comprises shear bolts securing at least one said strap to said bar sections, said shear bolts being made to shear upon sufficient impact to said bar.

19. An impact absorbing curtain for selectively covering a space defined by a door frame comprising:

a flexible sheet of suitably strong material having a front surface, rear surface, a top edge and a bottom edge and vertical side edges, including a bottom bar assembly secured to the bottom edge of said sheet, said bottom bar assembly comprising a hinge and two bottom bar sections each connected to said hinge and extending in opposite directions from the hinge along the bottom edge of the curtain, each bar section being secured to the bottom edge of said curtain;

at least one connecting member connected to both of said bottom bar sections and extending across said hinge, said at least one connecting member securing said bar sections in a relative straight, aligned orientation; and securing means for connecting said at least one connecting member to said bar sections, said securing means releasing on impact to allow hinging of the bottom sections about said hinge and thereby reduce the possibility of damage to the sheet and an impacting object.

20. A curtain as recited in claim 19 wherein the top edge of the sheet is secured to a barrel adapted to be rotatably mounted above said door frame, said sheet being coilable upon said barrel for storage thereupon and selectively extendable downwardly therefrom to extend over the door space.

21. A curtain as recited in claim 19 wherein said securing means comprises shear bolts securing said at least one connecting member to said bar sections, said shear bolts being made to shear upon sufficient impact to said bar.

22. A curtain as recited in claim 21 wherein each said bar section comprises a pair of horizontally extending mating angle members secured together and between which is sandwiched the bottom edge of said sheet.

23. A bottom bar assembly for a roll-up curtain for a door arrangement, said bar assembly comprising: two elongate bottom bar sections for attachment to a bottom edge section of said roll-up curtain, each bar section having an attachment arrangement for attaching the bar section to said bottom edge section of the curtain;

a hinge pivotably connecting adjacent ends of said bottom bar sections so that said bar sections can extend in opposite directions from said hinge and are aligned with each other during normal use of the bar assembly;

at least one connecting member connected to both of said bottom bar sections, extending across said hinge, and securing said bottom bar sections so that they form a relatively straight bottom bar adapted to extend along said bottom edge, each of said at least one connecting member being connected to at least one of said bottom bar sections by a shear connecting device, wherein said at least one connecting member is able to disconnect from at least one of said bottom bar sections upon a sufficiently large impact on said bottom bar assembly during use thereof, said impact causing said shear connecting device to break and this disconnection allowing one of said bar sections to pivot about said hinge relative to the other bar section and thereby reduce the possibility of significant damage to said door arrangement.

24. A bottom bar assembly according to claim 23 wherein said bottom bar sections are substantially equal in length and said hinge is centrally located on the bar assembly.

25. A bottom bar assembly according to claim 23 wherein said at least one connecting member is a rigid strap which is connected to said bar sections by two of said shear connecting device, each shear connecting device comprising a shear bolt.

26. A bottom bar assembly according to claim 25 wherein there are two of said connecting members each extending along a respective longitudinal side of the bar assembly so that said connecting members are located on opposite sides of said curtain during use thereof.

27. A bottom bar assembly according to claim 23 wherein each bar section has a plastic tab member mounted at an outer end thereof and adapted to extend into a guide slot formed by one vertical side of said door arrangement during use of the curtain and bar assembly.

* * * * *